United States Patent [19]

Wall et al.

[11] 4,432,281

[45] Feb. 21, 1984

[54] SELF-INKING STAMPING DEVICE

[75] Inventors: Alexander C. Wall, Nokomis, Fla.; Leonard H. Sculler, Englishtown, N.J.

[73] Assignee: M & R Seal Press Co., Inc., Roselle, N.J.

[21] Appl. No.: 356,842

[22] Filed: Mar. 10, 1982

[51] Int. Cl.[3] ..... B41K 1/40; B41F 31/24

[52] U.S. Cl. ..... 101/334; 101/327; 101/104; 101/324

[58] Field of Search ..... 101/327, 102, 333, 334, 101/104, 108, 125; 400/199-202.2

[56] References Cited

U.S. PATENT DOCUMENTS

| | | | |
|---|---|---|---|
| Re. 18,441 | 4/1932 | Switzer | 400/202.2 |
| 827,347 | 7/1906 | Campbell | 101/334 |
| 1,976,288 | 10/1934 | Ludewigs | 101/333 |
| 2,829,594 | 4/1958 | Goc | 101/104 |
| 3,033,112 | 5/1962 | Cleveland et al. | 101/334 |
| 3,060,850 | 10/1962 | Dewyer | 101/333 |
| 3,158,094 | 11/1964 | Harris | 101/327 |
| 3,216,352 | 11/1965 | Schnackel | 101/333 |
| 3,241,482 | 3/1966 | Keck | 101/333 |
| 3,251,299 | 5/1966 | Duke et al. | 101/334 |
| 3,312,193 | 4/1967 | Satas | 101/333 |
| 3,364,856 | 1/1968 | Lind | 101/334 |
| 3,421,437 | 1/1969 | Funahashi | 101/327 |
| 3,442,209 | 5/1969 | Funahashi | 101/327 |
| 3,885,495 | 5/1975 | Funahashi | 101/327 |
| 4,054,093 | 10/1977 | Funahashi | 101/327 |
| 4,289,070 | 9/1981 | MacGregor | 101/327 |

FOREIGN PATENT DOCUMENTS

| | | | |
|---|---|---|---|
| 2020162 | 10/1971 | Fed. Rep. of Germany | 101/334 |
| 1281086 | 11/1961 | France | 101/334 |
| 206200 | 10/1939 | Switzerland | 101/333 |

*Primary Examiner*—William Pieprz

*Attorney, Agent, or Firm*—Albert C. Johnston

[57] ABSTRACT

An improved self-inking hand stamping device comprises improved arrangements of parts of an encasing operating member relative to a frame member containing an invertible stamp carrying platen, and of an ink pad holder relative to the frame member and other parts inside the operating member; and a new construction of the ink pad holder enables clean and controlled inking of the ink pad in a holder kept in working position.

13 Claims, 8 Drawing Figures

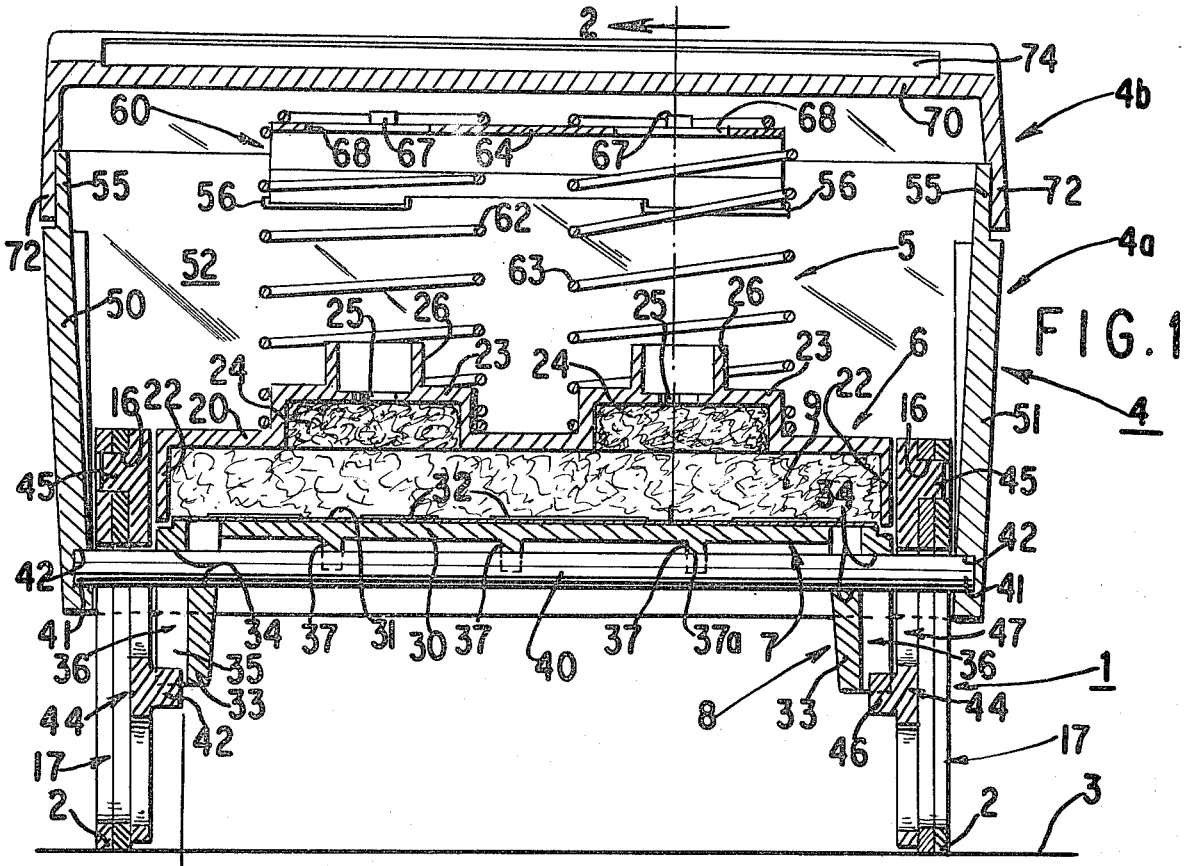
FIG. 1
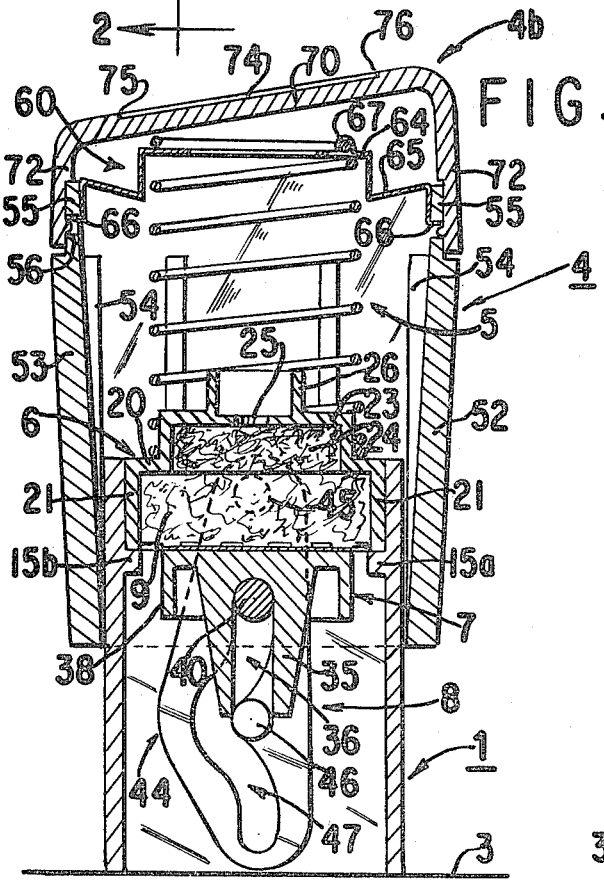
FIG. 2
FIG. 3
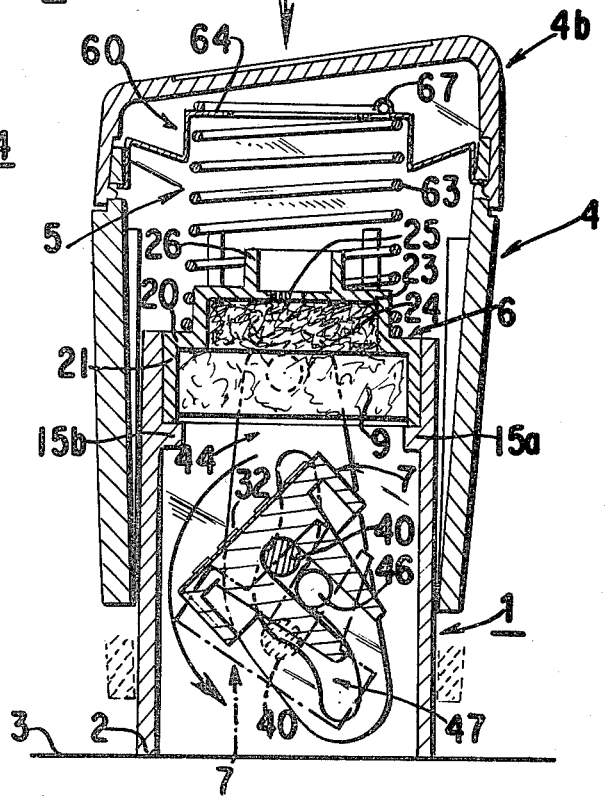

FIG. 4
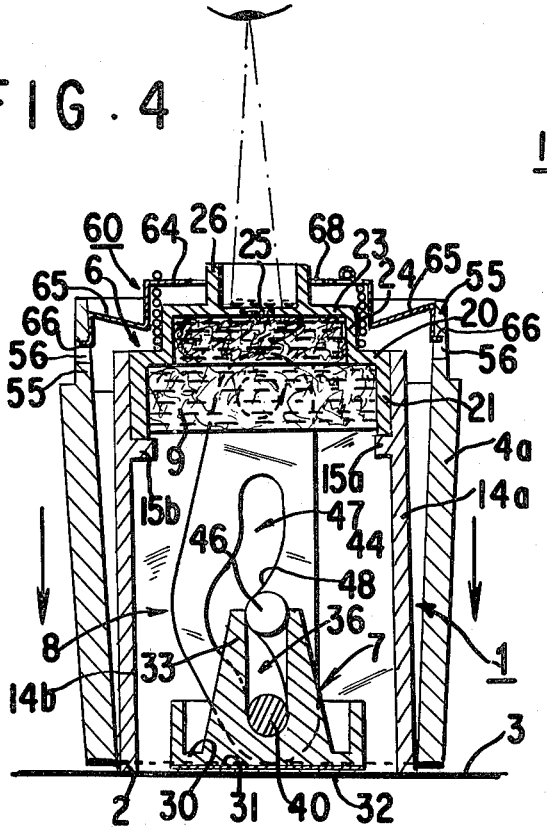
FIG. 5
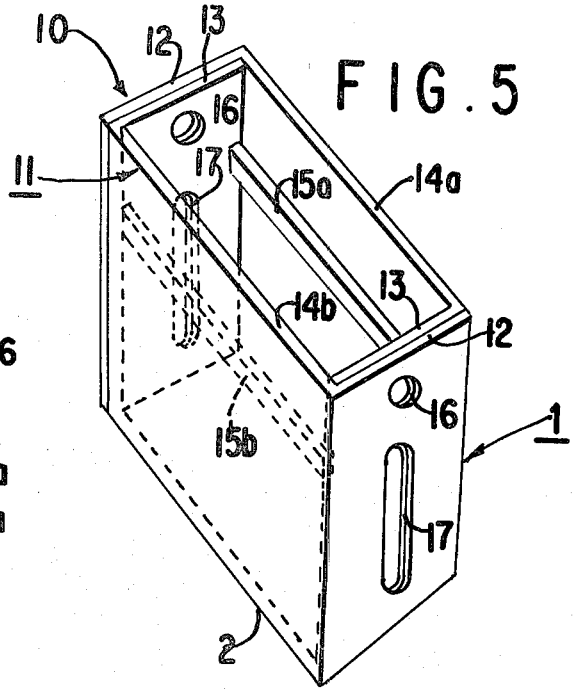
FIG. 6
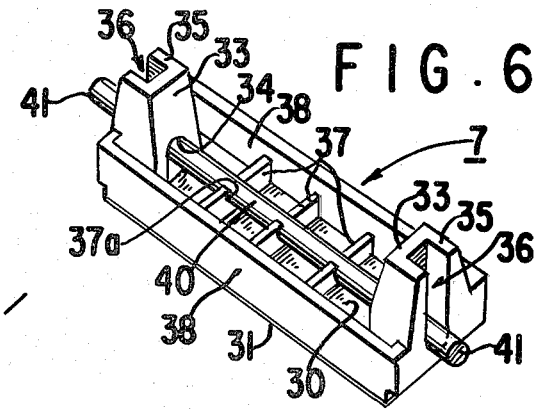
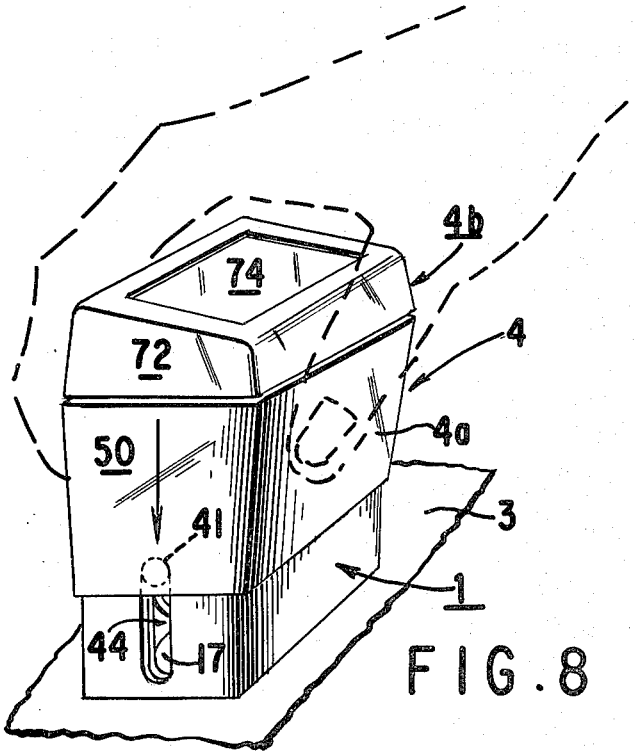
FIG. 8
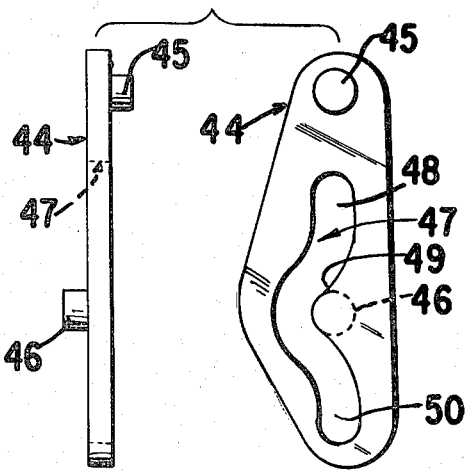
FIG. 7

SELF-INKING STAMPING DEVICE

This invention relates to a self-inking stamping device of a kind useful for quickly making ink impressions on documents, envelopes, container surfaces, or the like, by being grasped in a person's hand and positioned and pressed down by hand against a surface to be stamped.

Stamping devices of that kind have long been known. Various forms of such devices are disclosed, for instance, in U.S. Pat. Nos. 1,121,940, 2,079,080, 2,312,727, 2,919,645, 3,402,663, 3,631,799, 3,952,653 and 3,988,987.

Other forms of self-inking stamping devices which are commercially available are considered preferable to the devices shown in those patents. It has been observed, however, that these commercial devices have objectionable features, or shortcomings, in several respects.

For instance, their construction comprises a hollow base or frame member having upwardly extended side walls between which an upper member, housing compressed springs, is fitted reciprocably so that the side walls may be grasped between one's thumb and indexing fingers and the upper member depressed by the forefinger for operating the device. Thus, they are not suited for being grasped in a person's hand from any direction about the device and then easily placed for use and operated by the same hand position.

Further, although the stamp operating upper member has sloped surfaces that can be used for displaying indicia or information of a stamp to be impressed by the device, indicia on either of those surfaces is legible only in a direction to one side of the device and is hardly visible from a viewpoint directly above the device as needed for identification of a particular desired stamp when several of the stamping devices are stored close together. Also, those sloped surfaces are not wide enough to accommodate indicia covering the width of the stamp-carrying platen of the device, so are not suitable for displaying the full imprint of a stamp as wide as the platen.

Still further, the commercial devices mentioned employ an ink pad holder in an arrangement which makes it difficult to replenish the ink supply of the pad when it becomes dry, or to replace one ink pad holder by another for a change of ink color, without soiling one's fingers with ink. For re-inking or replacing the ink pad, the pad holder must be pushed laterally and then grasped and pulled by a person's fingers from slots formed in the side walls of the hollow base or frame member of the device. In these manipulations the fingers often are soiled by coming into contact with the ink pad.

The principal object of the present invention is to provide an improved self-inking stamping device which does not have the above-mentioned objectionable features, or shortcomings.

More particularly, according to this invention, a self-inking stamping device is provided which can be easily grasped, placed for use and operated by a person's hand engaging opposite sides of an operating upper member of the device from any direction and at any location about the device, as by taking the device between fingers or into a palm of one's hand, without need for changing the hand position.

The invention is another aspect provides an operating member constituted by a hollow encasement fitted with a closure over its top, which encasement is sloped outward in upward direction from its bottom to its top and merges with the closure so that the closure can present a flat upwardly facing top surface substantially corresponding in width and length to the open area of the device where the stamp platen operates. Thus, a top surface is provided suitably for displaying an imprint of the largest stamp that can be accommodated by the platen of the device. Moreover, by being sloped at an acute angle to the horizontal, the top surface defines a front of the device which is readily apparent so that the device can always be oriented in a correct manner for use and a correctly oriented imprint made in each stamping operation, with avoidance of upside down imprints.

According to further features of the invention, a self-inking stamping device is provided with a new arrangement of the ink pad holder relative to a platen-containing frame member, and relative to spring means and a bridge member provided in the operating member of the device, so that the ink pad holder is accessible from the top of the operating member for re-inking the ink pad without removing it, or for removing the ink pad holder to replace it by one of another color, when a top closure of the operating member is removed.

Still further, a new form and arrangement of the ink pad holder is provided whereby a person applying ink for absorption in the pad can easily determine when a correct amount of ink has been added, thus avoiding over-inking of the pad and resultant messiness.

The above-mentioned and other objects, features and advantages of the invention will be farther evident from the accompanying drawings and the following detailed description of an illustrative embodiment of the invention. In the drawings:

FIG. 1 is a longitudinal vertical cross-sectional view on an enlarged scale of a self-inking stamping device embodying the invention;

FIG. 2 is a transverse sectional view thereof, taken along line 2—2 of FIG. 1;

FIG. 3 is a view similar to that of FIG. 2 but showing the parts in positions intermediate their idle position and their stamping position;

FIG. 4 is a transverse sectional view of parts of the device in a position for re-inking the ink pad;

FIG. 5 is a perspective view of the frame member of the device;

FIG. 6 is a perspective view of the stamp-carrying platen and the axle of the device;

FIG. 7 comprises end and side elevational views of a cam lever of the device; and FIG. 8 is a schematic view of the device as placed and being operated by a user's hand to make an imprint.

The stamping device as shown in the drawings comprises an upright hollow frame member 1 having an open lower end at 2 to bear against a supporting surface indicated at 3. An upper, operating member 4 interfits with and is displaceable vertically relative to the frame member 1. Spring means generally indicated at 5 normally hold the operating member in an upward position from which by one's hand it can be thrust downward relative to the frame member 1 to a stamping position.

An ink pad holder 6 containing an ink pad 9 is supported by the frame member 1 at a distance above the open lower end 2. A displaceable stamp-carrying platen 7 is located inside the frame member in the space between its lower end and the ink pad 9, and coacting means 8 of generally known nature, having parts connected respectively with the platen 7, the frame member 1 and the operating member 4, are provided for disposing the platen in an inking position at the ink pad holder 6 when the operating member is in its normal, upward position and disposing the platen in an inverted position to impress a surface at the lower end of the frame member when the operating member is depressed to stamping position.

The operating member 4 comprises an upright wall forming a hollow encasement 4*a* that surrounds the frame member and has a closure 4*b* fitted removably over its top. Each of the parts 4*a* and 4*b* preferably is made in one piece as a suitably rigid and durable molding of any suitable plastic material, for example, of an acrylonitrile-butadiene resin known as ABS.

The frame member 1 is a substantially straight upright rectangular box structure 10 which is open at both its bottom and its top as shown in FIG. 5. This structure is formed, in a manner known per se, of two similar U-shaped parts 11 which preferably are moldings of a tough resilient plastic material, such as ABS resin. Each part 11 has a base portion and two end walls 12 and 13, wall 12 extending slightly farther from the base portion than wall 13. The two parts are fitted together in oppositely disposed relation with their respective end walls 12 and 13 overlapping so that their respective base portions form spaced side walls 14*a* and 14*b* of the box structure, their lapped end walls forming its end walls.

According to the present invention, ledges 15*a* and 15*b* protrude inwardly from opposite walls of the frame member 1 into the space of the box structure 10 at a location spaced below but near its open top. These ledges in the embodiment shown are formed as ribs molded integrally with the respective base portions 14*a* and 14*b* of the parts 11, thus being on the longer side walls of the box structure and providing a firm support on which the ink pad holder 6 is seated simply by being placed into the open top of the box.

The ink pad holder 6, as shown in FIGS. 1–4, is a tray-like structure of elongate rectangular form which comprises a rigid backing 20 having side walls 21 and end walls 22, for holding an ink absorbent pad 9 in downwardly faced position over and between the ledges 15*a* and 15*b*. The side walls 21 seat on the ledges. The backing 20 is formed with at least one and preferably two upwardly protruding portions 23 which form pockets 24 wider than they are thick and opening downwardly into the space occupied by the ink pad 9. The pockets 24 are filled with an ink receptive material, for instance discs or pads of felt, which aids distribution of ink from the pockets into the main body of the ink pad 9. The part of the backing portion 23 overlying each pocket 24 has a small opening 25, for instance a hole of about 2 to 3 mm. in diameter, leading through it for conducting ink into the related pocket. When the closure 4*b* is removed from the encasement 4*a*, the ink pad holder and the inking openings 25 are accessible from a location above the frame member 1, as described more particularly hereinafter.

Further according to the invention, as shown in FIGS. 1–4, each portion portion 23 of the ink pad holder backing has thereon an upwardly open cup formation 26 which surrounds the inking opening 25 and can receive a limited quantity of ink for dissemination into the ink pad 9. Each cup formation 26 is made to hold only a few drops of the ink required for the ink pad of the stamp. When the ink pad 9 needs to be re-inked, one can drop ink into each cup at 26 until the cup is nearly full, and the ink then will be drawn quickly through the holes 25 into the felt pads in the pockets 24, from which it desseminates into the main body of the ink pad 9.

After several such fillings of the cups 26, the felt pads in the pockets at 24 become saturated and ink will stand in the cups. This condition is a signal that the re-inking is sufficiently complete. It occurs when upper regions of the ink pad are saturated, and before too much ink reaches the lower pad region engaged by a stamp on the platen 7. When this signal is observed, one can cease adding ink and the ink standing in the cups 26 will then seep gradually into the ink pad without over-inking it, leaving the cups dry.

The stamp-carrying platen 7 normally is disposed in an upward position, as shown in FIGS. 1 and 2, where the raised indicia or information characters 32 of a rubber stamp strip 31 or the like fixed to the face of the platen base 30 are held in an inking position at the face of the ink pad 9 in holder 6. The platen is movable from that upward or inking position to an inverted, stamping position at the lower end of the frame member 1, where the stamp indicia on the platen will impress against a surface at that lower end, by the action of the mechanism generally indicated at 8, which is operated by downward movement of the operating member 4 relative to frame member 1 against the force of the spring means 5. This spring force normally holds the operating member 4 in an upper, stamp-inking position of the parts as seen in FIGS. 1 and 2, and returns the parts to that position from their downward, stamping position when the operating member 4 is released from hand pressure overcoming the spring force. The platen itself (see FIGS. 1 and 6), comprises not only the base 30 on which a stamp strip is carried but also a stiffening skirt wall 38 along the sides and the ends thereof and stiffening cross-ribs 37. The cross-ribs 37 are formed with semicylindrical recesses 37*a* which serve as bearing surfaces for an axle rod 40 that extends centrally along the underside of the platen. Each end of the platen also has an arm 33 formed integrally with it and protruding perpendicularly from its underside. Each arm 33 has flanges 35 spaced apart to form a laterally outwardly open channel or cam track 36, and a bearing opening 34 is formed through each arm near the platen base 30 to receive the axle rod 40.

The axle rod 40 extends along and beyond the full length of the platen 7, thus supporting the platen pivotably and protruding from it to rod ends 41. The protruding ends pass through respective cam slots 47 of the cam levers 44 and through straight vertical slots 17 formed in the end walls of the frame member 1. The ends 41 are seated in sockets 42 (FIG. 1) formed in and near the bottom of opposite end portions of the encasement wall 4*a*.

By reason of the rod 40 being thus connected with the platen, confined in the vertical slots 17 of the frame member, and fixed to the operating member 4, the disposition of the axle rod and platen in vertical direction is determined by the position of the operating member 4. Yet the engagement of the axle rod in the cam slots 47 of the levers 44 and connections of these levers with the frame member 1 and the platen arms 33 cause the platen to be inverted as it is moved between the inking and stamping positions by movement of the operating member 4 and rod 40.

Each of the cam levers 44 is formed with an integral pivot post 45 at its upper end, which post is fitted pivotably in an opening 16 formed in an end wall of the frame member 1 near its upper end. See FIGS. 1 and 7. Each cam lever also has a cam pin 46 protruding inwardly from it so as to engage into and be guided by the channel or cam track 36 of one of the platen arms 33. The cam slot 47 of each lever 44 comprises a straight upper portion 48 which merges into a humped portion 49 that is curved about the axis of the cam pins 46 and then merges into a straight lower portion 50.

It results that as the platen 7 and rod 40 are moved downward by movement of the operating member 4 or encasement 4*a*, the parts of the rod being forced along the humped portions 49 of the cam slots in the levers 44 deflect these levers about the axis of their mounting pins 45 and cause their cam pins 46 acting in the tracks 36 to displace the platen arms 33 so that the descending platen is turned about the axis of rod 40 and will be in a downwardly faced position when the rod reaches the bottom portion 50 of the cam slots. The same coacting parts turn the platen back to its upwardly faced position for engagement with the ink pad 9 upon the reverse, upward movement of the platen with the operating member 4 and rod 40. The showings in full lines in FIG. 3 indicate relative positions of the parts when the platen is partially turned by downward movement of the operating member. A further turned position of the platen and corresponding lower positions of the operating member and rod 40 are indicated by dot-dash lines in FIG. 3.

As may be seen from FIGS. 1–4 and 8, the hollow encasement 4*a* surrounding the frame member 1 and the slots 17 are sufficiently deep vertically that the encasement encompasses substantially the entirety of the frame member when depressed to stamping position. A person desiring to make an imprint by use of the stamping device can grasp the device in his hand by fingers engaging opposite sides of the encasement at or from any location about the device, and can even grasp the device into the palm of a hand, and then by the same hand, without need for changing its position, can place the device at the desired imprint location and operate the device to make an inked impression of a stamp carried on the platen 7. The hand position for grasping, placing and operating the device can be any that will occur most readily when a person reaches for and takes hold of the device by hand.

Further according to the invention, the encasement wall 4*a* of the operating member 4 comprises end panels 50 and 51 and side panels 52 and 53, which panels are molded with substantially uniform thickness and slope outwardly in upward direction from the bottom substantially to the top thereof. Inward protrusions such as sloped ribs 54 which widen in upward direction are provided along the inner sides of the end panels 50 and 51, and if desired along the side panels 52 and 53 as well, so as to limit the operating member to a rectilinear path of movement relative to the frame member 1.

The encasement wall panels 50–53 have at their top a rim section 55 of reduced thickness which fits inside and holds in place a merging skirt portion 72 of the closure 4*b* so that the closure is removably engaged onto the upper end of the encasement 4*a*. By virtue of the outward slope of the encasement wall, its upper end or top and the merging closure 4*b* are considerably bulged relative to its lower end and the open lower end 2 of frame member 1. This enlargement aids the grasping, placement and operation of the stamping device in one's hand. In addition, it enables the closure 4*b* to present on its top panel 70 a flat upwardly facing top surface area 74 which substantially corresponds in width and length to the open area of the lower end 2 of the frame member and thus is suitable for displaying the full imprint of any stamp that can be accommodated on the platen 7 of the stamping device.

The top panel 70 of closure 4*b* and its flat top surface area 74 are sloped upwardly from front to back regions thereof at an acute angle to the horizontal, thus defining an instantly recognizable front of the stamping device so that a person using the device will not inadvertently make upside-down imprints. Further, the front and back, or longitudinal, borders 75 and 76 of the flat top surface 74 are substantially aligned vertically with longitudinal borders of the open end area at 2. This helps a user to position the stamping device on a surface to be stamped so that the stamp indicia will be impressed at the desired location.

The encasement 4*a* has a bridge member 60 fixed across its upper end. This bridge member forms a seat for the spring means 5 which, in the embodiment shown, consists of coiled springs 62 and 63 compressed between the bridge member and the backing 20 of the ink pad holder 6. The bridge member 60 preferably is a substantially rigid though resilient part, such as a stamping of sheet metal. In the form shown, it has a central base portion 64 to support the upper ends of the springs and has at opposite sides of portion 64 bent resilient leg portions 65 which terminate in tongues 66 engaged in notches 56 formed in the rim 55 of the encasement wall (see FIGS. 2 and 4).

Either of the resilient leg portions 65 of the bridge member can be sprung inwardly relative to the rim 55 to release the adjacent tongue or tongues 66 from engagement with notches 56, or to re-engage the same, for detaching and re-attaching the bridge member when desired. Each of the springs 62 and 63 has an uppermost coil disposed on base portion 64 of the bridge member and suitably fixed to it, for instance by an upstruck retainer 67 bent over the coil. The lowermost coils of the springs are connected with the ink pad holder 6, for instance by being fitted onto and gripping its upwardly protruding backing portions 23. Thus, with the closure 4*b* removed from the encasement 4*a*, the bridge member 60 can be detached from the rim 55 and lifted out of the encasement so as to remove the springs and the ink pad holder with it as a unit.

This manner of removal of the ink pad holder eliminates all need for touching it with one's fingers. A used ink pad holder so removed can be flicked off the gripping spring coils with a pencil or other handy instrument and then replaced in those coils by another, similar ink pad holder, as when it is desired to change the color of the imprints to be made by the stamping device.

According to further features of the invention, as may be seen in FIGS. 1–4, upon removal of the closure 4*b* from the encasement 4*a*, the inking openings 25 of the ink pad holder and their ink measuring cups 26 are easily accessible for the delivery of ink into them, as required when an ink pad 9 becomes too dry of ink or when a fresh ink pad holder is installed before being inked for use. The bridge member is made with a cut away or otherwise open area 68 located over each inking opening 25 and cup 26. Ink can be delivered into each cup and thence through its hole 25 into the ink pad by use of an eye dropper or a like device suitably disposed through an open area of the bridge member.

For utmost convenience and accessibility in inking or re-inking the ink pad of a holder 6 in working position, each of the cup formations 26 is located in vertical alignment with an open area 68 of the bridge member, being for instance inside and substantially on the axis of the coils of one of the springs 62 and 63. Thus, when the encasement 4*a* is depressed relative to the frame member 1 to stamping position, as shown in FIG. 4, each cup 26 protrudes through the related open area 68 of the bridge member. It results that the ink pad in the holder 6 can be inked simply by removing the closure 4*b*, pressing the encasement 4*a* down to and holding it at its stamping position against a supporting surface, and then applying ink, preferably dropwise, into the cups 26. The cups then protrude from the top of the bridge member so that a person inking the pad can easily observe the filling conditions of the cups by eye, thus easily avoiding the spilling of ink from or outside the cups and over-inking of the ink pad.

It will be understood that the new features of the invention disclosed herein are intended to be defined by the appended claims and that they can be utilized in various forms and ways, without limitation to particulars of the illustrative embodiment except as may be required by fair construction of the claims.

What is claimed is:

1. In a stamping device comprising an upright hollow frame member having an open lower end to bear against a supporting surface, an operating member interfitting with and displaceable vertically relative to said frame member, spring means normally holding said operating member in an upward position from which by one's hand it can be pressed downward relative to said frame member to a stamping position, an ink pad holder supported by said frame member at a distance above said lower end, a displaceable stamp-carrying platen inside said frame member, and coacting means connected respectively with said platen, said frame member and said operating member for disposing said platen in an inking position at said holder when said operating member is depressed to stamping position;

the improvement wherein said operating member comprises an upright wall forming a hollow encasement that surrounds and has a height greater than that of said frame member, has a closure fitted removably onto its upper end, and encompasses substantially the entirety of said frame member when depressed to stamping position, whereby the stamping device can be easily grasped, placed for use and operated by a person's hand engaged with opposite sides of the device from any direction and at any location about the operating member, said encasement wall sloping outward substantially from its bottom to a rim on its upper end, said closure having a skirt portion engaging about said rim and merging with the top of said wall, and spring seating means bridging and fixed to said rim, said spring means being compressed between said ink pad holder and said seating means and thus continuing to be active upon removal of said closure.

2. A stamping device according to claim 1, said closure having a top panel presenting an upwardly facing top surface for displaying the stamp indicia of the device, which surface is sloped at an acute angle to the horizontal from one side to the opposite side of said skirt portion so that it defines the front of the device, said top surface comprising a substantially flat surface area corresponding in width and length at least to the dimensions of said platen, the longitudinal borders of said surface area being substantial aligned vertically with those of the open area of said open end, thereby aiding a user to position the device for desired location of an imprint of said indicia.

3. A stamping device according to claim 1 or 2, said encasement wall being a plastic molding of substantially uniform thickness having along its inner side inward protrusions which widen in upward direction so as to limit said operating member to a rectilinear path relative to said frame member.

4. In a stamping device comprising an upright hollow frame member having an open lower end to bear against a supporting surface, an operating member interfitting with and displaceable vertically relative to said frame member, spring means normally holding said operating memeber in an upward position from which by one's hand it can be pressed downward relative to said frame member to a stamping position, an ink pad holder supported by said frame member at a distance above said lower end, a displaceable stamp-carrying platen inside said frame member, and coacting means connected respectively with said platen, said frame member and said operating member for disposing said platen in an inking position at said holder when said operating member is in said upward position and disposing said platen in position to impress a surface at said lower end when said operating member is depressed to stamping position, the improvement wherein said operating member comprises an upright wall forming a hollow encasement that surrounds and has a height greater than that of said frame member, a top closure having a skirt portion fitted removably onto and about the upper end of said encasement and a bridge member fixed to and across said upper end, said spring means comprising at least one spring compressed between said ink pad holder and said bridge member, said ink pad holder comprising a rigid backing to hold thereunder a downwardly faced ink absorbent pad and pad inking means on said backing for receiving ink and passing it to said pad with said holder kept in normal working position relative to said frame member, said encasement and said spring means; said inking means including at least one upwardly open cup fomation protruding upwardly from said backing to receive drops of ink and capable of holding only a few drops at a time, and at least one opening inside said upper encasement end at the level of said bridge member and through which upon removal of said closure each said cup formation is accessible from above said encasement for dropping ink into the cup formation.

5. A stamping device according to claim 4, said backing having at least one downwardly open pocket forming portion that protrudes upwardly therefrom and holds over and in contact with said pad a mass of ink receptive material to receive ink and distribute it into said pad, said mass being small in volume relative to the size of said pad, each said pocket forming portion having a small opening thereinto through the top thereof for conducting ink into said mass therein and having a said cup formation protruding upwardly from its top about its said opening.

6. A stamping device according to claim 4, said bridge member being open in an area thereof over and vertically aligned with each said cup formation so that the cup formation is accessible via the aligned open area for delivery of ink thereinto.

7. A stamping device according to claim 6, each said cup formation being located centrally of and inside a coiled spring comprised by said spring means.

8. A stamping device according to claim 6 or 7, each said cup formation protruding into a said open area of said bridge member when said encasement is depressed relative to said frame member to a stamping position.

9. In a stamping device comprising an upright hollow frame member having an open lower end to bear against a supporting surface, an operating member interfitting with and displaceable vertically relative to said frame member, spring means normally holding said operating member in an upward position from which by one's hand it can be pressed downward relative to said frame member to a stamping position, an ink pad holder supported by said frame member at a distance above said lower end, a displaceable stampcarrying platen inside said frame member, and coacting means connected respectively with said platen, said frame member and said operating member for disposing said platen in an inking position at said holder when said operating member is in said upward position and disposing said platen in position to impress a surface at said lower end when said operating member is depressed to stamping position, the improvement wherein said operating member comprises an upright wall forming a hollow encasement surrounding said frame member and having an openable closure at its top and a bridge member fixed across the upper end of said encasement, said spring means comprising at least one spring compressed between said ink pad holder and said bridge member, said holder being accessible from the top of said encasement upon opening of said closure, said ink pad holder being seated removably into an upper portion of said frame member, said bridge member being fixed detachably to said encasement, each said spring being a coiled spring having opposite ends thereof interengaged with parts respectively of said bridge member and said holder so that the bridge member, spring means and ink pad holder may be removed as a unit from the stamping device upon detachment of the bridge member from said encasement.

10. An ink pad holder for a stamping device, comprising a rigid backing to hold thereunder a downwardly faced ink absorbent pad, said backing having at least one downwardly open pocket forming portion that protrudes upwardly therefrom and is filled with, and holds in contact with said pad, a mass of ink receptive material to receive ink and distribute it into said pad, said mass being substantially wider over its area of contact with said pad than it is thick yet being small in volume relative to the size of said pad, each said pocket forming portion having a small opening thereinto through the top thereof for conducting ink gradually into said mass therein and having an uncovered upwardly open cup formation protruding upwardly from its top about its said opening to receive a limited quantity of ink for dissemination through its said opening into its said mass and thence into said pad, each said cup formation being of a size capable of holding a few but only a few drops of ink at a time.

11. An ink pad holder according to claim 10, said backing being of elongate rectangular form and having thereon a plurality of said pocket forming portions spaced apart therealong, each said ink conducting opening being of about 2 to 3 mm in diameter.

12. In a stamping device comprising an upright hollow frame member having an open lower end to bear against a supporting surface, an operating member interfitting with and displaceable vertically relative to said frame member, spring means normally holding said operating member in an upward position from which by one's hand it can be pressed downward relative to said frame member to a stamping position, in ink pad holder supported by said frame member at a distance above said lower end, a displaceable stamp-carrying platen inside said frame member, and coacting means connecting respectively with said platen, said frame member and said operating member for disposing said platen in an inking position at said holder when said operating member is in said upward position and disposing said platen in position to impress a surface at said lower end when said operating member is depressed to stamping position, the improvements wherein:

said operating member comprises an upright wall forming a hollow box-like encasement that surrounds and has a height greater than that of said frame member and has a removable closure fitted onto its upper end;

said frame member being a substantially straight rectangular box open at its top and bottom and having ledges protruding inwardly from opposite side walls thereof at a location near its top, said ink pad holder being seated inside said box on said ledges;

said encasement having a bridge member fixed detachably to and across its upper end, said spring means comprising a pair of coiled springs compressed between said ink pad holder and said bridge member; each of said springs having opposite ends thereof inter-engaged with parts respectively of said bridge member and said holder so that the bridge member, spring means and ink pad holder may be removed as a unit from the stamping device upon detachment of the bridge member from said encasement;

said holder comprising a rigid backing to hold thereunder a downwardly faced ink absorbent pad and a pair of downwardly open pockets protruding upwardly from said backing to receive ink and distribute it into the pad, each of said pockets having an opening thereinto through the top thereof for conducting ink into the pocket;

each said pocket also having an upwardly open cup formation thereon about each said opening to receive a limited quantity of ink for dissemination into the pad;

each cup formation being capable of holding only a few drops of ink at a time and being located centrally of and inside one 13. A stamping device according to claim 12, said encasement wall sloping outward from its bottom to a rim on its upper end, skid closure having a skirt portion engaging about said rim and merging with said wall, and having a top panel presenting an upwardly facing top surface for displaying the stamp indicia of the device, which surface comprises a substantially flat area that corresponds in width and length at least to the dimensions of said platen and has its longitudinal borders substantially aligned vertically with those of the open area of said open end, said surface being sloped at an acute angle to the horizontal from one side to the opposite side of said skirt portion so that it defines the front of the device.

* * * * *